US007706959B2

(12) United States Patent
Bruhn et al.

(10) Patent No.: US 7,706,959 B2
(45) Date of Patent: Apr. 27, 2010

(54) METHOD FOR ADJUSTING THE AIR/FUEL RATIO OF AN INTERNAL COMBUSTION ENGINE

(75) Inventors: Sven Bruhn, Gifhorn (DE); Matthias Schultalbers, Meinersen/OT Ahnsen (DE); Thomas Von Der Ohe, Gifhorn (DE)

(73) Assignee: IAV GmbH Ingenieurgesellschaft Auto und Verkehr, Berlin (DE)

( * ) Notice: Subject to any disclaimer, the term of this patent is extended or adjusted under 35 U.S.C. 154(b) by 201 days.

(21) Appl. No.: 11/922,290

(22) PCT Filed: Mar. 24, 2007

(86) PCT No.: PCT/DE2007/000546

§ 371 (c)(1),
(2), (4) Date: Dec. 14, 2007

(87) PCT Pub. No.: WO2007/118444

PCT Pub. Date: Oct. 25, 2007

(65) Prior Publication Data

US 2009/0138182 A1 May 28, 2009

(30) Foreign Application Priority Data

Apr. 18, 2006 (DE) ..... 10 2006 017 863
Oct. 19, 2006 (DE) ..... 10 2006 049 348
Oct. 19, 2006 (DE) ..... 10 2006 049 350

(51) Int. Cl.
*F02D 41/14* (2006.01)
*F01N 11/00* (2006.01)

(52) U.S. Cl. ..... 701/109

(58) Field of Classification Search ..... 701/109, 701/108, 102; 123/672, 681, 683, 688, 690, 123/478, 480; 73/114.73, 118.1, 116
See application file for complete search history.

(56) References Cited

U.S. PATENT DOCUMENTS 4,917,067 A 4/1990 Yoshida
5,325,711 A 7/1994 Hamburg et al.

(Continued)

FOREIGN PATENT DOCUMENTS

DE 38 31 289 5/1989

(Continued)

OTHER PUBLICATIONS

International Search Report.

*Primary Examiner*—Hieu T Vo
(74) *Attorney, Agent, or Firm*—Collard & Roe, P.C.

(57) ABSTRACT

A method is for adjusting a fuel/air ratio by means of an on-off controller as well as a diagnostic method in which a desired fuel/air mixture is regulated in accordance with a test signal of a lambda probe that is embodied as a jump probe. The switching point of the on-off controller is moved/adapted while the oscillation of the test signal of the lambda probe is analyzed regarding the amplitude and/or the asymmetry of the oscillation around the switching point at a constant control stroke. A desired value for the asymmetry or the amplitude of the oscillation of the test signal of the lambda probe around the respective switching point is predefined, the switching point of the on-off controller being moved such that the desired value is reached.

14 Claims, 3 Drawing Sheets

U.S. PATENT DOCUMENTS

Figure 1:
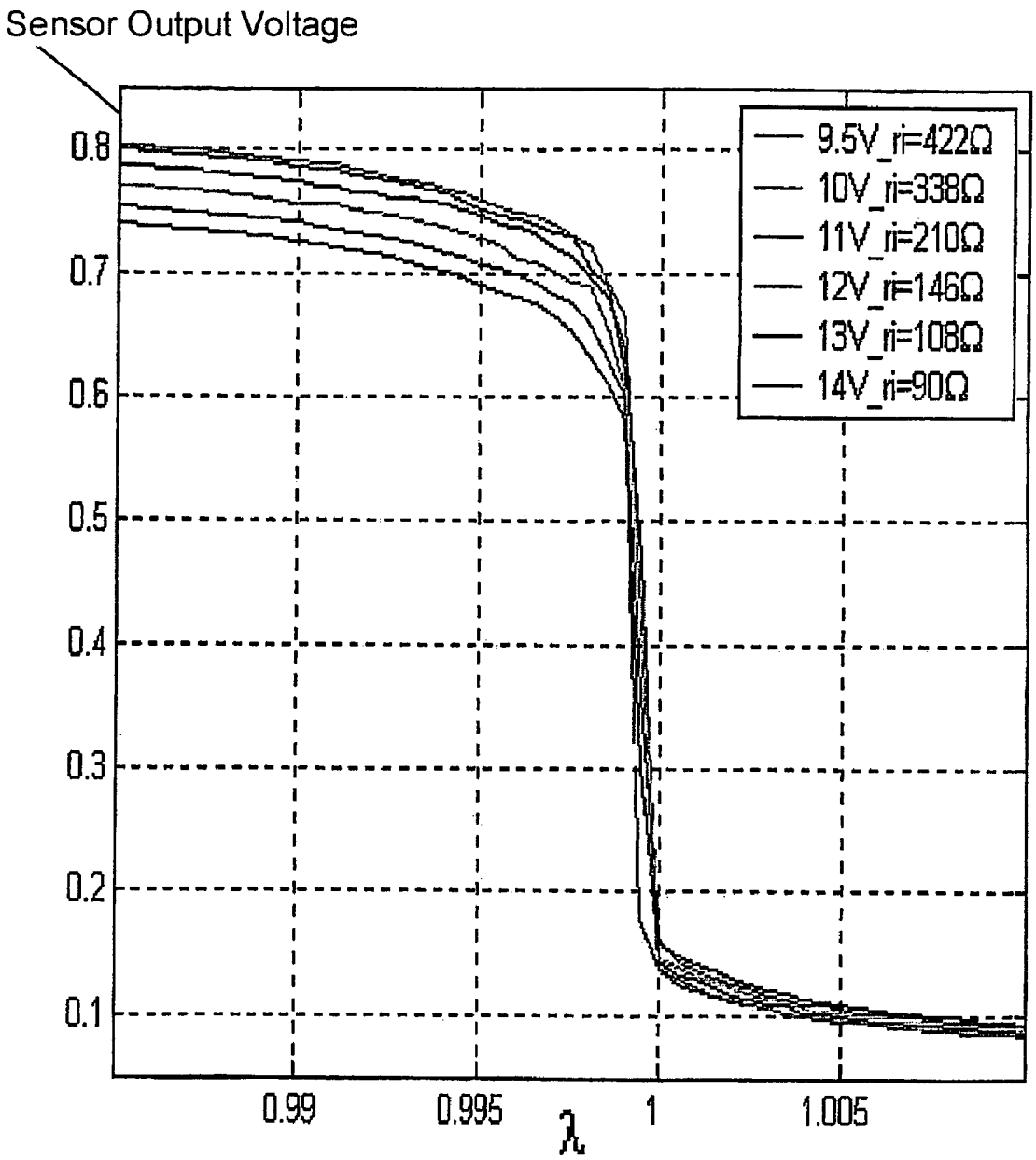

| | | | | |
|---|---|---|---|---|
| 5,357,937 | A * | 10/1994 | Bauer et al. | 123/683 |
| 5,392,599 | A | 2/1995 | Hamburg et al. | |
| 5,462,040 | A * | 10/1995 | Krebs et al. | 123/688 |
| 5,488,858 | A * | 2/1996 | Achleitner | 73/114.73 |
| 6,279,559 | B1 * | 8/2001 | Mauro et al. | 123/672 |
| 6,287,453 | B1 | 9/2001 | Rösel et al. | |

FOREIGN PATENT DOCUMENTS

| | | |
|---|---|---|
| DE | 44 22 115 | 1/1995 |
| DE | 44 46 930 | 7/1995 |
| DE | 198 44 994 | 4/2000 |
| DE | 100 04 416 | 8/2001 |
| DE | 102 06 399 | 5/2003 |
| EP | 1 122 415 | 8/2001 |
| EP | 1 336 743 | 8/2003 |

* cited by examiner

METHOD FOR ADJUSTING THE AIR/FUEL RATIO OF AN INTERNAL COMBUSTION ENGINE

CROSS REFERENCE TO RELATED APPLICATIONS

Applicants claim priority under 35 U.S.C. §119 of German Application No. 10 2006 017 863.7 filed Apr. 18, 2006, German Application No. 10 2006 049 348.6 filed Oct. 19, 2006, and German Application No. 10 2006 049 350.8 filed Oct. 19, 2006. Applicants also claim priority under 35 U.S.C. §365 of PCT/DE2007/000546 filed Mar. 24, 2007. The international application under PCT article 21(2) was not published in English.

The invention relates to a method for adjusting the air/fuel ratio of an internal combustion engine. In order to adjust the air/fuel ratio of an internal combustion engine, the signal of at least one exhaust gas sensor is evaluated, and adjustment of the desired air/fuel ratio takes place in a control or regulation device, by means of adaptation of the fuel amount supplied to the internal combustion engine. So-called lambda sensors, which measure the oxygen proportion in the exhaust gas, are previously known as exhaust gas sensors. In this connection, a distinction is made between sensors that measure continuously, with an almost linear sensor characteristic curve specified over the entire range, and bistable sensors having a strongly non-linear characteristic curve of the oxygen proportion to the output voltage of the sensor. Bistable sensors used in lambda regulation have a switching characteristic that brings about a strong change in the sensor output voltage at a slight change in the lambda value, in the range around lambda equal to 1. For reasons of cost, bistable sensors that are precisely specified only in the characteristic curve range of the rich/lean transition, at a lambda value close to 1, and have a great incline there, are increasingly being used for lambda regulation. Therefore, this sensor is usually used only in two-point regulator structures for regulating a mixture value close to lambda 1. Lambda reference values that deviate from the stoichiometric work point can therefore be approached only in controlled manner. In operating situations run in controlled manner, such as catalytic converter heating (operation with desired "lean" fuel/air mixture lambda>1, preferably between 1.01 and 1.05) and component protection, as well as enrichment for acceleration (operation with lambda<1, typical values for component protection and acceleration enrichment lie in the range of 0.99 to 0.85, there are great deviations from the desired lambda value, in part.

The diagnosis of a lambda sensor is previously known from DE 198 44 994 C2, in which the adaptation value of a model that represents the lambda regulation circuit is monitored, with periodic compulsory regulation of the regulation segment. One of the model parameters is the sensor delay time, whose deviation is monitored in the model adaptation, and a significant deviation indicates a defective lambda sensor. The method is used for continuous lambda sensors.

Furthermore, a diagnosis for a bistable sensor in a closed regulation circuit is previously known from DE 44 22 115 C2, whereby the regulation circuit has a periodic compulsory excitation superimposed on it, and a diagnosis of the lambda sensor takes place from the resulting sensor signal, in comparison with the excitation. No displacement of the switching point of the two-point regulator takes place.

A method for adjusting the air/fuel ratio is previously known from DE 100 04 416 A1, having an exhaust gas sensor system ahead of the catalytic converter, and an exhaust gas sensor system behind the catalytic converter. In separate operating ranges of the internal combustion engine, for example when traveling downhill, in which a deviation from the stoichiometric ratio is supposed to take place, a switch to controlled operation ("open loop") takes place. The air/fuel amount is set on the basis of predefined adjustment variables, in the case of controlled operation, without any feedback of the measured value from the lambda sensor. Here, great deviations from the actual desired lambda value occur, due to the control without measured value feedback. No regulation of the air/fuel mixture takes place in operating ranges in which operation with an air/fuel ratio deviating from the stoichiometric ratio (lambda not equal to 1) intentionally takes place. In the transition from controlled to regulated operation, in which a stoichiometric ratio is once again supposed to be regulated, regulated operation takes place for a short time, in a limited transition range, on the basis of the signal of the bistable sensor ahead of the catalytic converter. For this purpose, the switching point of the bistable sensor is adapted by means of the lambda sensor behind the catalytic converter, with the post-regulation system shut off, in order to ensure a desired conversion rate of the catalytic converter. The sensor-related shape of the characteristic curve, which makes a great change in the voltage value available in the range around lambda 1, at slight changes of the lambda value, but has a very flat progression of the characteristic curve in ranges where lambda is not equal to 1, is disadvantageous for regulating the fuel/air mixture by means of a bistable sensor. As a result, only a slight voltage change is measured when the lambda values change, in ranges that deviate from the stoichiometric ratio. Regulation by means of a two-point regulator is therefore imprecise. The drift in the characteristic curve that occurs as the result of aging of the sensors is also problematic. While the sensor still provides measurement values of the fuel/air mixture that are sufficiently differentiated for regulation, in the bistable range around lambda equal to 1, a drift in the characteristic curve in the range deviating from the stoichiometric ratio leads to the result that predefined switching points are no longer reached in the specified border regions of the characteristic curve. Regulation by means of a two-point regulator is particularly subject to error in the flat region of the characteristic curve of a bistable sensor.

It is therefore the task of the invention to indicate a method for adjusting a fuel/air mixture, which method allows the most precise possible regulation of the fuel/air mixture, for a lambda regulation by means of at least one bistable sensor, for lambda reference values that deviate from the stoichiometric ratio. Furthermore, a regulation device is created that allows a diagnosis of the lambda sensor.

This task is accomplished, according to the invention, in that two-point regulation takes place around a switching point, whereby the switching point of the two-point regulator is adapted to set a desired lambda value. In this connection, the oscillation of the measurement signal of the lambda sensor around the switching point is recorded, whereby a regulation stroke that remains the same is assured. A reference value is predetermined with regard to the oscillation of the measurement signal of the lambda sensor, around the switching point, in each instance, and the reference value of the two-point regulator is displaced in such a manner that the reference value of the oscillation occurs. Different amplitude-related parameters of the oscillation are evaluated as a characteristic of the oscillation. In this connection, regulation takes place to a reference value of the oscillation, whereby the switching point of the two-point regulator sets itself as a function of this value.

At a defined regulation stroke (preferably 2% deviation from the set fuel mass), the sensor output voltage that occurs is measured with regard to the amplitude of its vibration (so-called residual ripple). Regulation to the measurement variable of the residual ripple takes place in such a manner that the switching point of the two-point regulator is displaced until the desired residual ripple, which can be predefined, occurs. The method proceeds from the recognition that the sensor characteristic curve drifts due to temperature or aging, with regard to the assignment of the sensor output voltage to the lambda value. Surprisingly, the residual ripple correlates to a lambda value that can be assigned, at a predetermined regulation stroke, in a manner that is stable with aging and temperature, to a great extent. It is advantageous that according to the invention, a desired adjustment of the lambda value is achieved by means of displacing the switching point until a residual ripple that can be predetermined is achieved, without predetermining an absolute switching point for the regulator.

An evaluation of the curvature of the sensor characteristic curve, which is specific for a related lambda value, takes place. In this connection, it is advantageous that according to the invention, the shape of the sensor characteristic curve, which can be assigned to a defined lambda value in a manner that is stable with temperature and aging, to a great extent, is analyzed.

The non-symmetry of the oscillation of the sensor output voltage in a two-point regulation is determined as the equivalent of the curvature of the sensor characteristic curve. At a defined regulation stroke (preferably 1-2% deviation from the set fuel mass), the sensor output voltage that occurs is analyzed with regard to its oscillation. It is advantageous that according to the invention, the non-symmetry of the oscillation is evaluated with reference to the switching point. For this purpose, the amplitude of the half-waves, i.e. their area content with reference to the threshold value are determined. The ratio of the half-waves, i.e. their amplitude and/or area content is used as a guidance variable for the regulation. The curvature and its equivalent, determined by way of the non-symmetry, is independent of the absolute value of the sensor output voltage, and allows a regulated approach to lambda values in the non-specified "rich and/or lean branch" of the sensor characteristic curve, which runs very flat, by means of the two-point regulation used for regulation of the stoichiometric ratio.

Regulation to the non-symmetry of the oscillation of the sensor output voltage takes place in such a manner that the switching point of the two-point regulator is displaced until the desired non-symmetry, which can be predetermined, occurs. The method proceeds from the recognition that the sensor characteristic curve drifts due to temperature or aging, with regard to the assignment of the sensor output voltage to the lambda value, but that surprisingly, the characteristic curve shape is stable with regard to aging and temperature, and at a predetermined regulation stroke, an equivalent for the characteristic curve shape can be formed by means of analyzing the non-symmetry of the oscillation. It is advantageous that according to the invention, a desired adjustment of the lambda value is achieved by means of adapting the switching point until a non-symmetry of the oscillation of the sensor output voltage that can be predetermined is achieved, without predetermining an absolute switching point for the regulator. The latter is obtained, in the final analysis, from the regulation to the non-symmetry.

Setting a desired lambda value in regulated operation is advantageous, so that a great deviation of the lambda value, compared with controlled operation, is avoided.

It is advantageous that according to the invention, the existing structure of the regulation—as it is present in the state of the art, for stoichiometric operation as a two-point regulation—is used also for adjusting lambda values that deviate from the stoichiometric ratio.

Proceeding from the recognition that the characteristic curve changes in the case of drift due to aging or temperature, particularly in the border regions of the sensor characteristic curve, the signal of the lambda sensor is considered when the switching point is displaced away from the stoichiometric ratio. A non-symmetry of the oscillation of the sensor output voltage in a two-point regulation is brought about by means of the curvature of the sensor characteristic curve that changes over the lambda value, while the regulation stroke remains the same. In this connection, the regulation stroke preferably amounts to 1-2% deviation from the set fuel mass, in the case of two-point regulations that are carried out. Not only the non-symmetry of the oscillation around the switching point that occurs at a defined switching point, but also the switching point of the sensor output voltage that occurs at a predetermined non-symmetry can be determined. The amplitude of the half-waves, i.e. their surface content with reference to the threshold value are determined for the analysis of the non-symmetry. The ratio of the half-waves, i.e. their amplitude and/or surface content can be used as a guide variable for the regulation, and the switching point that occurs is considered for the diagnosis.

In this connection, regulation to the non-symmetry of the oscillation of the sensor output voltage takes place in such a manner that the switching point of the two-point regulator is displaced until the desired non-symmetry, which can be predetermined, occurs.

It is advantageous that according to the invention, the existing structure of the regulation—as it is present in the state of the art for stoichiometric operation as two-point regulation—is also utilized for the diagnosis. As an expansion, all that occurs is a comparison with previously determined standard values.

It is advantageous that according to the invention, an evaluation of the sensor output signal with regard to the residual ripple of the oscillation of the sensor output signal when switching point displacement occurs takes place for diagnosis, alternatively or in addition to the non-symmetry that is determined.

It is advantageous that according to the invention, the diagnosis takes place in operating ranges at which a lambda value that deviates from the stoichiometric ratio is regulated, in regulated manner (e.g. catalytic converter heating or component protection).

In the following, the invention will be described using drawings of an exemplary embodiment. Additional advantageous embodiments can be derived from the claims.

Figure 2:
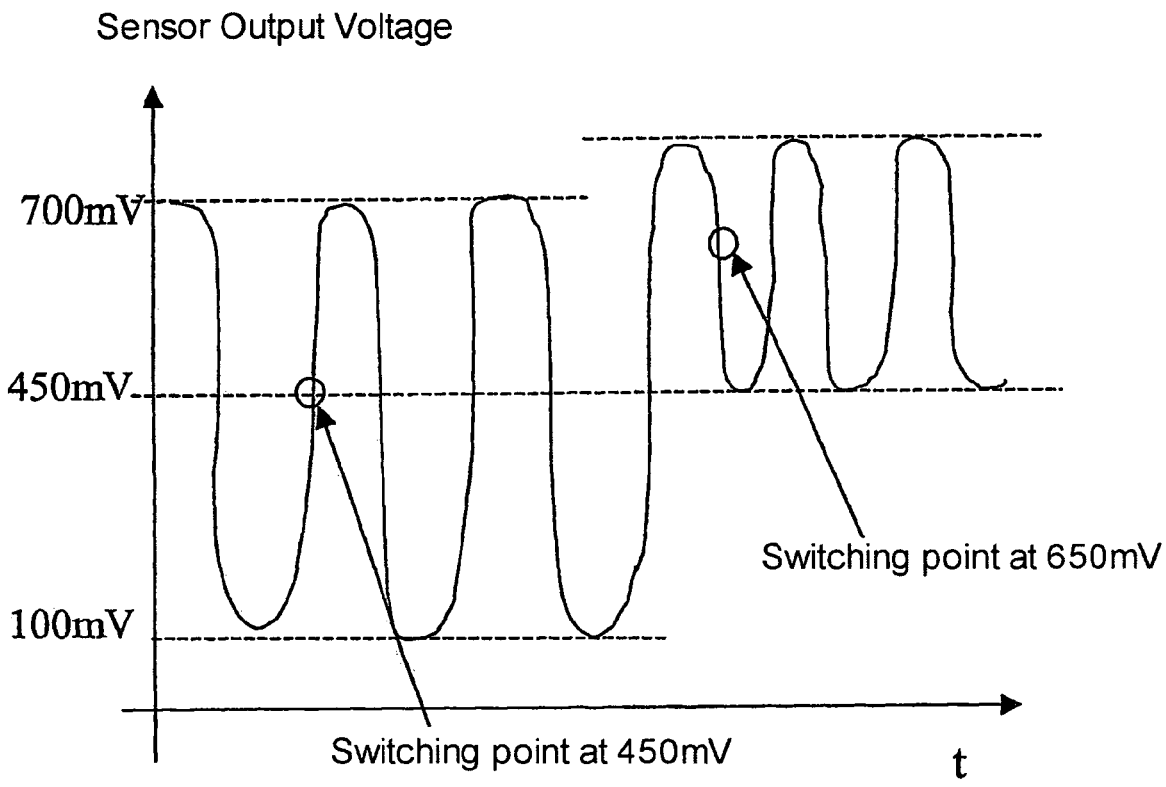
Figure 3:
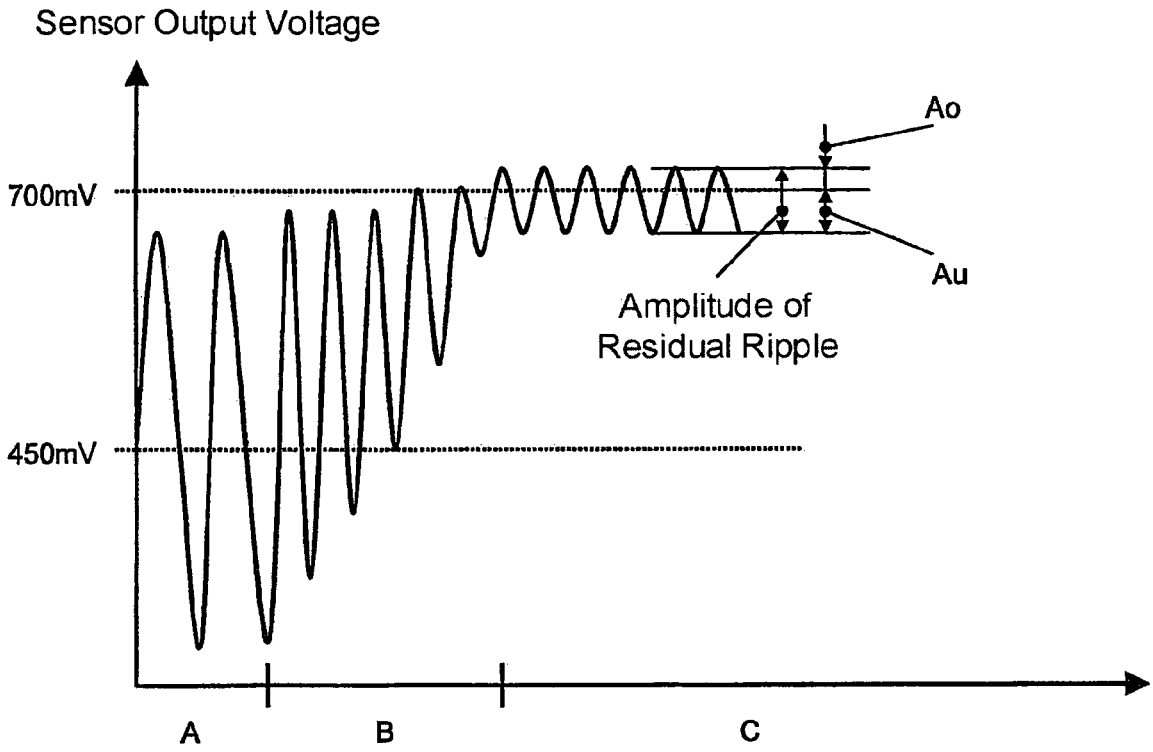

The figures show:

FIG. 1: characteristic curve progressions of the sensor output voltage over the lambda value for the bistable sensor, at different temperatures, FIG. 2: the signal progression of the sensor output voltage over time, in the case of a bistable sensor having a switching point shift of the two-point regulator, FIG. 3: the signal progression of the sensor output voltage over time, in the case of a bistable sensor having a switching point shift of the two-point regulator.

Lambda regulation is necessary for diesel engines having a three-way catalytic converter, since the latter is able to effectively reduce the pollutant components HC, CO, and $NO_x$ only in a very narrow range of the fuel/air ratio (lambda value). The lambda window (regulation range of the bistable sensor in the case of two-point regulation in accordance with the state of the art) lies in a range between lambda values of 0.99 to 1. The required accuracy is only achieved with a regulation that is configured as a two-point regulation, having a switching point at a desired lambda value close to 1. Only qualitative information about the lambda value can be provided with the signal of the bistable sensors. The signal of the injection amount is modified as a function of the measured lambda value. If the lambda signal indicates values greater than or less than 1, the regulation is influenced in the direction of the desired lambda value by means of a change in the set value (injection amount) around a defined value or a value stored in characteristic curves (regulation stroke). In this way, a pendulum movement around the desired lambda value occurs, which can be measured by means of an oscillation of the signal of the sensor output voltage. Different sensor characteristic curves are shown as examples in FIG. 1. The lambda regulation adapts the following injection, in each instance, on the basis of the previous measurement. The adaptation of the injection amount on the basis of the lambda sensor signal is referred to as the regulation stroke. However, the measurement has a time offset relative to the injection because of the gas running times, the computation time in the control device, and the response time of the lambda sensor, so that a minimal period duration of the oscillation of the lambda value occurs.

In order to set a stoichiometric air/fuel ratio, the regulation switching point usually lies in the specified stable range at 450 mV. This corresponds to a lambda value close to 1. Due to the influences of aging and temperature on the sensor characteristic curve, the sensor characteristic curve changes, particularly in the non-specified border regions. If a "lean" or "rich" fuel/air mixture is supposed to be adjusted with the present two-point regulation, the switching point must be displaced downward (200 mV, for example) or upward (700 mV, for example). In this connection, the non-specified lean or rich branch, respectively, of the sensor characteristic curve is used. The characteristic curve of a bistable sensor is shown in FIG. 1. The sensor output voltage is represented as a function of the lambda value. The lambda sensor was heated to different temperatures by means of different heating voltages, and different sensor characteristic curves are found for one and the same sensor, as a function of the temperature. The deviations from the sensor characteristic curve are shown as examples for different temperatures, particularly in the non-specified border regions. Since these characteristic curve regions have a very flat progression, only a slight change in the sensor output voltage takes place in the border regions of the characteristic curve, at great changes in the lambda value. If the border regions of the sensor characteristic curve are displaced due to the influences of aging or temperature (as shown in FIG. 1), a switching point defined in fixed manner, outside of lambda 1, would lead to the result that the regulated lambda drifts greatly. Furthermore, it can happen that a switching point defined in fixed manner is not even reached any more.

According to the invention, this can be avoided in that the oscillation of the sensor output voltage is monitored, in the case of regulation around an adapted switching point, at a predetermined regulation stroke. According to the invention, the switching point is displaced piece by piece, and according to a first embodiment of the invention, the resulting oscillation of the sensor output voltage is evaluated with regard to its amplitude (so-called residual ripple). A displacement of the switching point takes place, while the regulation stroke remains the same, up to a defined threshold value of the residual ripple. As a result, the residual ripple becomes a guide variable of the regulation.

The invention proceeds from the recognition that the shape of the characteristic curve is stable with regard to aging and/or temperature, to a great extent. This means that the absolute measurement value of the sensor voltage for a related lambda value drifts over the useful lifetime and/or over the temperature, but the shape of the sensor characteristic curve sensor voltage=f (lambda value) is maintained and therefore a weak or strong rise or flattening of the sensor characteristic curve can be assigned to a defined lambda value, in each instance. Thus, the curvature of the sensor characteristic curve can be used as a measure for the lambda value. The curvature of the sensor characteristic curve cannot be measured directly in operation of the regulation device, without a comparison measurement. A two-point regulation, which has a switching point in the transition range of the sensor characteristic curve, close to lambda=1, is used for regulating the stoichiometric ratio. This regulator structure is furthermore also used for the regulation according to the invention, outside of the stoichiometric mixture, whereby its switching point is adapted and its property of generating an oscillation of the measurement signal of the lambda sensor is utilized. The switching point of the two-point regulator is displaced, and the resulting oscillation of the sensor output voltage that is brought about by the regulation stroke that remains the same is evaluated with regard to its amplitude (so-called residual ripple). Furthermore, an evaluation of the measurement curve of the sensor output voltage takes place with regard to the symmetry of the oscillation. The measurement curve is evaluated with regard to the amplitude of the individual half-waves and/or the area enclosed between the half-waves, in each instance, and a straight line through the switching point. In this connection, an integration yields the area content of the half-wave of the measurement curve, in each instance. The two-point regulation works with a defined regulation stroke. Proceeding from the current measurement value of the sensor output voltage, the current injection amount is changed by a defined amount (for example, 2% of the current injection amount), so that the measurement value approaches the switching threshold. If the value goes above or below the switching threshold, a change in the injection amount, by the same amount, occurs once again. Thus, the lambda value, and therefore the measurement signal of the sensor output voltage, oscillates around the switching threshold. Because of the non-linear sensor characteristic curve, having a changing incline towards the border regions, a non-symmetrical oscillation around the switching point takes place in the regions that deviate from the stoichiometric ratio. In the following, a switching point will be considered as an example, at a sensor output voltage of 700 mV. In the case of active two-point regulation, an oscillation of the sensor output voltage around the switching point occurs, whereby a greater dip of the oscillation in the sensor output voltage takes place in the direction of lower voltage values, measured at the switching point. This is brought about by the fact that the regulation stroke remains the same, while the sensor characteristic curve changes over the regulation range. If the switching point of 700 mV is exceeded, a reduction in the injection amount by 2%, for example, takes place in accordance with the regulation strategy of the two-point regulator. As a result, the lambda value is steered in the direction of lean lambda values. Because of the gas running times, a reaction occurs with a delay, so that an over-swing of the lambda value in the direction of rich mixture values takes place. However, this is shown only to a slighter degree in the sensor output voltage, because the sensor characteristic curve becomes flatter in this region, as compared with the same over-swing in the direction of the stoichiometric ratio. Because of the two-point regulation strategy, a reverse control of the fuel amount, by the same amount (for example 2% of the injection amount) in the direction of the rich range takes place if the value goes below the switching point, thereby again causing an over-swing of the lambda value in the lean direction, because of the gas running times, and this has a stronger impact on the signal of the sensor output voltage, because the branch of the characteristic curve is configured more steeply in this region. If one evaluates the sensor output voltage with regard to under-swing and over-swing of the measurement signal around the switching point, a characteristic ratio of the half-waves to one another is obtained, as a function of the work point on the sensor characteristic curve. This ratio can be quantified by means of an evaluation of the amplitudes of the half-waves or an evaluation of the half-wave areas. The non-symmetry that can be measured in this way is therefore characteristic for the curvature of the sensor characteristic curve. The curvature of the sensor characteristic curve described by way of the non-symmetry of the half-waves of the oscillation of the sensor output signal is used as a guide variable for lambda values that deviate from the stoichiometric ratio. In this way, a regulated approach to switching points that lie on the non-specified lean or rich branch of the sensor characteristic curve takes place. Therefore lambda values that are, in the final analysis, reference values for a defined curvature value of the sensor characteristic curve, can be predetermined for the regulation. A prior identification must take place for this predetermination, for example the ratio of the half-wave areas to one another at a predetermined regulation stroke, so that the ratio of the areas to one another or the amplitudes of the half-waves to a defined lambda value is known, for example from prior studies on the test bench. For the regulation, the predetermination of a corresponding ratio of the amplitudes and/or the areas of the half-waves that describes the non-symmetry takes place on the basis of the lambda value to be adjusted. A displacement of the switching point takes place until the required value of non-symmetry is reached.

As already described, the oscillation of the measurement signal of the lambda sensor can be evaluated and used as a guide variable for the regulation. A regulation with regard to the amplitude of the oscillation (residual ripple) can be used for regulating "rich" or "lean" operating states.

Furthermore, the residual ripple or its amplitude can themselves be considered, parallel to the non-symmetry. The amplitude of the residual ripple is also a measure for the lambda value that is independent of the absolute values of the sensor output voltage. FIG. 2 explains the regulation in detail, in an example.

The non-symmetry of the half-waves and/or the amplitude of the residual ripple are specific for the switching point, in each instance. This is used for the diagnosis of the lambda sensor. For the diagnosis, a prior identification of the non-symmetry must take place, for example by means of determining the ratio of the half-wave areas to one another and/or by means of measuring the residual ripple at a predetermined regulation stroke, for predetermined switching points, using a functioning lambda sensor, for example by means of prior studies on the test bench. In this connection, a comparison of the standard values determined for a functioning sensor with the values determined in operation is required, and conclusions concerning the operating state of the lambda sensor can be drawn from the deviation of the values. A deviation in the non-symmetry and/or the residual ripple, particularly in the border regions of the sensor characteristic curve, is characteristic for a drift in the sensor characteristic due to aging or a defect. An evaluation of the deviation in comparison with test bench data of a sensor having an ideal sensor characteristic curve allows classification of the sensor with regard to its operating state and allows an estimation of the drift in the characteristic curve due to aging, and therefore a virtual characteristic curve correction. Furthermore, the sensor can be monitored with regard to its failure.

Furthermore, alternatively or parallel to the non-symmetry, the residual ripple, i.e. its amplitude can also be considered. The amplitude of the residual ripple is also a measure for the diagnosis of the lambda sensor, for a specific switching point. FIG. 2 shows an example of this, for determining the amplitude of the oscillation (residual ripple) of the measurement signal of the lambda sensor around the switching point.

FIG. 2 shows the sensor signal with an adapted switching point. A displacement of the switching point in the direction of a higher sensor output voltage takes place, whereby the regulation stroke is maintained. The partial region of the displacement of the switching point is hidden. The sensor output voltage after regulation to a residual ripple of 350 mV amplitude of the oscillation of the sensor output voltage has taken place is shown. Because of the flattening sensor characteristic curve, a swing movement with a lesser amplitude of the oscillation of the sensor output voltage takes place. According to the invention, the switching point is displaced until the desired amplitude of the oscillation of the sensor output voltage (for example 350 mV) has been reached. This value can be assigned to a lambda value. The relationship between lambda value and amplitude of the oscillation of the sensor output voltage must be determined in advance for a regulation stroke that is defined in the regulation algorithm. In practical operation of the lambda regulator, a regulation by means of the two-point regulator, to a defined switching point, furthermore takes place in operating ranges at lambda close to 1, for example 450 mV sensor output voltage for the bistable sensor being used as an example, having a sensor characteristic curve according to FIG. 1. In special operating ranges, for example heating of the catalytic converter or in operating ranges in which high exhaust gas temperatures are undesirable (so-called component protection), lambda values that deviate from lambda=1 are set. Here, the switching point is displaced in the direction of "rich" or "lean" (sensor output voltage less than or greater than 450 mV). At the same time, the amplitude of the sensor output voltage is measured, and regulation to a predetermined amplitude of the sensor output voltage takes place at a regulation stroke that remains the same (variation of the fuel amount to be injected if the value goes below or above the changing switching point, by 2% of the base injection amount, in each instance). When this happens, the sensor output voltage oscillates around a new switching point, which is defined by way of the amplitude of the oscillation of the sensor output voltage. Thus, regulation of the "rich" and "lean" operating states, respectively, takes place, while the regulator structure is maintained.

A switching point is set as a function of the real sensor characteristic curve, by means of the regulation to the amplitude of the oscillation of the sensor output voltage, as described. The switching points determined for specific operating points in the "lean" or "rich" range can be used for diagnosis purposes. Diagnosis information is obtained on the basis of the comparison of the switching points that occur with predefined switching points determined for ideal sensor characteristic curves, by means of the deviation from the switching points of the real sensor that is determined. If the switching points that are determined deviate from the values determined for an ideal sensor by a previously defined amount, the sensor is assessed as being defective.

FIG. 3 shows the two-point regulation with switching point adaptation in greater detail, using another example. Here, an embodiment of the invention is described in which the oscillation of the measurement signal of the lambda sensor is evaluated on the basis of the non-symmetry of the oscillation around the switching point. FIG. 3 shows the sensor output voltage over time, for a regulation process of a rich mixture that deviates from the stoichiometric ratio. The known two-point regulation takes place in partial region A, by means of a bistable sensor that has a characteristic sensor characteristic curve of the sensor output voltage to the lambda value—as shown in FIG. 1. In partial region A, the sensor output voltage oscillates around a switching point at 450 mV, which corresponds to a stoichiometric mixture. If a more fuel-rich mixture is now supposed to be set for special operating points, such as acceleration enrichment or component protection, this continues to take place in regulated manner. In this connection, the non-symmetry of the oscillation of the sensor output signal is used as the guide variable. A displacement of the switching point of the two-point regulator takes place (partial region B), until the predefined non-symmetry that belongs to the lambda value, in each instance, has been reached. This can be formed as a ratio of the amplitude of the half-waves upper half-wave Ao/lower half-wave Au, for example. Furthermore, the ratio of the areas of the upper to the lower half-wave can be used for evaluation, with reference to a straight line through the switching point.

In another embodiment of the invention, a combined two-point regulation with switching point adaptation takes place, in such a manner that the switching point is adapted on the basis of the residual ripple and the non-symmetry. In this connection, the regulation can be structured as a cascade regulation, whereby the inner regulation circuit contains the residual ripple regulation, and the outer regulation circuit contains the regulation to a value of the curvature of the sensor characteristic curve that is expressed by the asymmetry of the oscillation of the sensor voltage around the switching threshold.

The invention claimed is:

1. Method for adjusting a fuel/air mixture by means of a two-point regulator, in which method a desired fuel/air mixture is regulated as a function of a measurement signal of a lambda sensor configured as a bistable sensor, whereby the switching point of the two-point regulator is adapted, comprising the following method steps:

displacing the switching point of the two-point regulator in the direction of the desired lambda value, which deviates from the stoichiometric ratio, recording the oscillation of the measurement signal of the lambda sensor around the switching point, whereby a regulation stroke that remains the same is assured, predetermining a reference value of the oscillation of the measurement signal of the lambda sensor around the switching point, in each instance, displacing the switching point of the two-point regulator in such a manner that the reference value of the oscillation of the measurement signal of the lambda sensor occurs, whereby the set value of the injection amount is changed by a defined amount, if the measurement value goes above or below the switching threshold, so that the measurement value signal of the sensor output voltage oscillates around the switching threshold.

2. Method according to claim 1, wherein for a desired lambda value that deviates from the stoichiometric ratio, in each instance, predetermining a related amplitude of the oscillation (residual ripple) of the measurement signal of the lambda sensor and regulating by means of displacing the switching point of the two-point regulator.

3. Method according to claim 1, comprising displacing the switching point of the two-point regulator as a function of the identified curvature of the sensor characteristic curve, in the direction of the desired lambda value that deviates from the stoichiometric ratio, whereby a value of the non-symmetry of the oscillation of the sensor output voltage around the switching point generated from the two-point regulation, with the regulation stroke remaining the same, is determined as the equivalent of the curvature of the sensor characteristic curve, in that the amplitude and/or the area of the half-waves of the oscillation of the sensor output voltage around the switching point are evaluated.

4. Method according to claim 3, wherein for a desired lambda value that deviates from the stoichiometric ratio, in each instance, predetermining a related value of the non-symmetry of the oscillation of the measurement signal of the lambda sensor and regulating by means of displacing the switching point of the two-point regulator.

5. Method according to claim 3, wherein in addition, considering the amplitude of the oscillation of the measurement signal of the lambda sensor around the switching point, in each instance, (residual ripple) for the adaptation of the switching point.

6. Method according to claim 1, wherein for setting a "rich" air/fuel mixture, displacing the switching point of the two-point regulator in the direction of a higher sensor output voltage than the sensor output voltage at the turning point of the sensor characteristic curve, and that for setting a "lean" air/fuel mixture, displacing the switching point of the two-point regulator in the direction of a lower sensor output voltage than the sensor output voltage at the turning point of the sensor characteristic curve.

7. Method according to claim 1, comprising using the signal of the sensor output voltage of the lambda sensor ahead of the catalytic converter as the measurement signal.

8. Method according to claim 1, comprising determining a switching point that occurs for a predetermined non-symmetry of the oscillation of the measurement signal of the lambda sensor and a diagnosis of the lambda sensor takes place on the basis of the deviation from a predefined switching point.

9. Method according to claim 1, comprising determining a switching point that occurs for a predetermined amplitude of the oscillation of the measurement signal of the lambda sensor and a diagnosis of the lambda sensor takes place on the basis of the deviation from a predefined switching point.

10. Method according to claim 9, comprising displacing the switching point of the two-point regulator in the direction of the desired lambda value that deviates from the stoichiometric ratio, whereby a value of the non-symmetry of the oscillation of the sensor output voltage around the switching point generated from the two-point regulation, with the regulation stroke remaining the same, is determined, by evaluating the amplitude and/or the area of the half-waves of the oscillation of the sensor output voltage around the switching point.

11. Method according to claim 9, comprising determining a switching point that occurs for a predetermined non-symmetry of the oscillation of the measurement signal of the lambda sensor, and from this, reproducing the real progression of the sensor characteristic curve, with regard to its curvature, and evaluating the lambda sensor as being defective takes place on the basis of the deviation of the curvature from an ideal characteristic curve.

12. Method according to claim 1, wherein evaluating the lambda sensor signal takes place in the case of an adaptation of the switching point of the two-point regulator, and analyzing the lambda sensor signal at a displaced switching point, and evaluating of the lambda sensor with regard to its ability to function takes place on the basis of the deviation from previously set standards of a lambda sensor.

13. Method according to claim 1, wherein in the case of a defined displacement of the switching point of the two-point regulator, having an analysis of the output signal of the lambda sensor take place, and recording the residual ripple and/or non-symmetry of the oscillation of the output signal around the switching point that occurs at a predetermined regulation stroke that is kept constant during the displacement of the switching point and evaluating the lambda sensor with regard to its ability to function takes place on the basis of the deviation from the previous standard values determined for a lambda sensor.

14. Method according to claim 1, wherein in the case of a displacement of the switching point of the two-point regulator, while keeping constant the regulation stroke having an analysis of the output signal of the lambda sensor take place, and adjusting a desired lambda value that deviates from the stoichiometric ratio, in such a manner that a related value of the non-symmetry of the oscillation of the measurement signal of the lambda sensor and/or the residual ripple is predetermined and regulated by means of displacement of the switching point of the two-point regulator, and determining the switching point of the two-point regulator that results from the predetermination of the non-symmetry and/or the residual ripple in this way and evaluating the lambda sensor with regard to its ability to function takes place on the basis of the deviation from the previous standard values of the switching point determined for a lambda sensor.

* * * * *